US007812242B2

(12) United States Patent
Yamabata et al.

(10) Patent No.: US 7,812,242 B2
(45) Date of Patent: Oct. 12, 2010

(54) ELECTRONIC MUSICAL INSTRUMENTS

(75) Inventors: Toshio Yamabata, Hamamatsu (JP); Taro Umemoto, Hamamatsu (JP); Hiroyuki Yasunaga, Hamamatsu (JP)

(73) Assignee: Roland Corporation, Hamamatsu (JP)

( * ) Notice: Subject to any disclaimer, the term of this patent is extended or adjusted under 35 U.S.C. 154(b) by 113 days.

(21) Appl. No.: 12/201,336

(22) Filed: Aug. 29, 2008

(65) Prior Publication Data

US 2009/0056527 A1 Mar. 5, 2009

(30) Foreign Application Priority Data

Sep. 4, 2007 (JP) ..... 2007-228810

(51) Int. Cl.
*G10H 1/00* (2006.01)

(52) U.S. Cl. ..... 84/629; 84/662

(58) Field of Classification Search ..... 84/615, 84/624, 626, 629, 653, 662
See application file for complete search history.

(56) References Cited

U.S. PATENT DOCUMENTS

| | | | | | |
|---|---|---|---|---|---|
| 3,854,366 | A | * | 12/1974 | Deutsch | 84/655 |
| 3,895,553 | A | * | 7/1975 | Kawamoto | 84/706 |
| 3,920,905 | A | * | 11/1975 | Sharp | 381/62 |
| 3,979,996 | A | * | 9/1976 | Tomisawa et al. | 84/629 |
| 4,083,284 | A | * | 4/1978 | Nakada | 84/706 |
| 4,173,164 | A | * | 11/1979 | Adachi et al. | 84/695 |
| 4,198,892 | A | * | 4/1980 | Gross | 84/704 |
| 4,747,332 | A | * | 5/1988 | Uchiyama et al. | 84/655 |
| 4,957,030 | A | * | 9/1990 | Suzuki | 84/604 |
| 5,027,690 | A | * | 7/1991 | Wachi et al. | 84/626 |
| 5,200,569 | A | * | 4/1993 | Moore | 84/723 |
| 5,286,916 | A | * | 2/1994 | Yamauchi | 84/661 |
| 5,292,995 | A | * | 3/1994 | Usa | 84/626 |
| 5,313,010 | A | * | 5/1994 | Matsushima et al. | 84/600 |
| 5,496,963 | A | * | 3/1996 | Ito | 84/653 |
| 5,763,807 | A | * | 6/1998 | Clynes | 84/705 |
| 5,781,636 | A | * | 7/1998 | Tai | 381/62 |
| 7,094,962 | B2 | * | 8/2006 | Kayama | 84/609 |
| 7,626,113 | B2 | * | 12/2009 | Kuroda | 84/659 |
| 2004/0035284 | A1 | * | 2/2004 | Tamura et al. | 84/634 |
| 2004/0112203 | A1 | * | 6/2004 | Ueki et al. | 84/613 |

(Continued)

FOREIGN PATENT DOCUMENTS

| | | |
|---|---|---|
| JP | 07-121165 | 5/1995 |

(Continued)

*Primary Examiner*—David S. Warren
(74) *Attorney, Agent, or Firm*—Foley & Lardner, LLP

(57) ABSTRACT

Various embodiments of the present invention are directed to providing a musical tone control device for carrying out appropriate control in user-performed operations. A pitch parameter value PB set by a pitch bend wheel may be loaded and a determination may be made whether the pitch parameter value PB is within a specified range. If the pitch parameter value PB is within the specified range, a time t may advance by 1, and a determination may be made whether the time t has reached t1. If the time t has reached t1, an amplitude value from a low frequency oscillator (LFO) table corresponding to the time t may be read out from the LFO table. The vibrato value VI may be calculated by multiplying the amplitude value and the vibrato depth. The pitch parameter value PB and the vibrato value VI may be added and transmitted to the sound source.

20 Claims, 4 Drawing Sheets

U.S. PATENT DOCUMENTS

| | | | | |
|---|---|---|---|---|
| 2004/0177745 | A1* | 9/2004 | Kayama | 84/609 |
| 2005/0145103 | A1* | 7/2005 | Haga | 84/738 |
| 2006/0081119 | A1* | 4/2006 | Kuroda | 84/659 |
| 2006/0185504 | A1* | 8/2006 | Kobayashi | 84/645 |
| 2008/0066609 | A1* | 3/2008 | Bourgeois | 84/609 |
| 2008/0072742 | A1* | 3/2008 | Nishida | 84/615 |
| 2009/0056527 | A1* | 3/2009 | Yamabata et al. | 84/624 |

FOREIGN PATENT DOCUMENTS

| | | |
|---|---|---|
| JP | 09-198046 | 7/1997 |

* cited by examiner

ELECTRONIC MUSICAL INSTRUMENTS

CROSS-REFERENCE TO RELATED PATENT APPLICATIONS

Japan Priority Application 2007-228810, filed Sep. 4, 2007 including the specification, drawings, claims and abstract, is incorporated herein by reference in its entirety.

BACKGROUND OF THE INVENTION

Embodiments of the present invention relate generally to a musical tone control device and, in particular, relate to a musical tone control device which may be controlled in conformance with performance operations by a user using an operation terminal during performance of the musical tone control device.

Musical tone control devices have always been popular among musical instrument players and often used for controlling a musical tone generated by an electronic musical instrument and the like, in order to achieve a desired musical performance. In these musical tone control devices, various kinds of control operations, including a modulation of the musical tone, can be operated by the user.

One such example is disclosed in Japanese Laid-Open Patent Application Publication (Kokai) Number H7-121165, which discloses a tone control device in which when a first operation terminal is operated, a pitch of a generated tone is gradually changed in a fixed manner (i.e., a pitch change occurs). When a second operation terminal is additionally operated while the first operation terminal is being operated, the pitch begins to periodically move up and down while keeping its center pitch at the pitch obtained when the second operation terminal was operated. This is known as a "vibrato effect," which is a frequent and periodical pitch change of a musical tone. At this time, the pitch is periodically set to be the center pitch.

Another example is disclosed in Japanese Patent Publication Number 3465466, which discloses a tone control device equipped with a pitch bend wheel. When the pitch bend wheel is manipulated or otherwise operated and then stopped (and remains stopped), a vibrato effect, which is produced by an LFO (low frequency oscillator), is automatically applied. On the other hand, when the pitch bend wheel is being moved or otherwise operated, a vibrato effect produced by the LFO may be suppressed. This allows novice users to achieve a vibrato effect automatically without operating the pitch bend wheel, which is known as an "automatic vibrato." In addition, this allows more experienced users to use the pitch bend wheel to apply and suppress the vibrato effect.

However, with the tone control device disclosed in Japanese Laid-Open Patent Application Publication (Kokai) Number H7-121165, it is difficult even for experienced users to start the vibrato effect at a user's desired pitch. First, the user would be required to operate the first operation terminal (e.g., the pitch bend wheel) to gradually change a pitch of a generated tone. Next, the user would be required to operate the second operation terminal to apply a vibrato effect when changing the pitch being manipulated by the first operation terminal reaches a desired pitch. This requires the user to determine himself or herself whether the pitch has reached the desired pitch, for example by listening to the changing pitch to determine whether the desired pitch has been reached.

In addition, with the tone control device disclosed in Japanese Patent Publication Number 3465466, the automatic vibrato may be applied unexpectedly when movement of the pitch bend wheel is stopped. This may occur, for example, even at an undesired pitch while the pitch bend wheel is being operated. In other words, because the vibrato effect is applied automatically, the user cannot obtain a desired altered pitch for a certain period of time (i.e., when the movement of the pitch bend wheel is stopped) without the vibrato being automatically applied.

SUMMARY OF THE DISCLOSURE

Embodiments of the present invention are directed to tone control devices and methods for generating an effect, such as a vibrato, at expected preset positions of an operation terminal.

A musical tone control device in accordance with an embodiment of the present invention may include, but is not limited to, an input means, a period signal generation means, a modulation signal generation means, an output means, a determination means, and a control means.

The input means may be for inputting a pitch parameter value corresponding to an operation of an operation terminal. The period signal generation means may be for generating a periodic signal. The modulation signal generations means may be for generating a modulation signal based on the pitch parameter value input by the input means and the periodic signal generated by the period signal generation means. The modulation signal may be for modulating a musical tone. The output means may be for outputting the modulation signal generated by the modulation signal generation means.

The determination means may be for determining whether the pitch parameter value input by the input means is within a specified range. The control means may be for suppressing the periodic signal when the determination means determines that the pitch parameter value input by the input means is out of the specified range. The control means may be for cancelling the suppressing of the periodic signal when the determination means determines that the pitch parameter value input by the input means is within the specified range.

Accordingly, when the pitch parameter value is out of the specified range, modulation by the periodic signal may be suppressed and the pitch of the musical tone may be modulated based on the pitch parameter value only and no additional modulation derived from the periodic signal may be applied. On the other hand, when the pitch parameter value is within the specified range, the pitch of the musical tone may be modulated based on both the pitch parameter value and the periodic signal.

As such, when the pitch parameter value is within the specified range, the modulation by the periodic signal may be applied, but the modulation by the periodic signal is not applied when the pitch parameter value is out of the specified range. Thus it may be possible to carry out appropriate control corresponding to an operation by the user. For example, the modulation (i.e., vibrato effect) may be applied when the pitch parameter value input by the input means increases and reaches or exceeds a predetermined pitch. On the other hand, in those cases where the pitch parameter value increases but does not equal or is less than the predetermined pitch, the vibrato effect is not applied.

In various embodiments, the device may further include a timing means. The timing means may be for measuring a length of time from when the pitch parameter value input by the input means changes from a value that was out of the specified parameter range to a value that is within the specified parameter range. The control means may cancel the suppressing of the periodic signal when the length of time measured by the timing means equals or exceeds a predetermined length of time.

In some embodiments the pitch parameter value input by the input means and the modulation signal generated by the modulation signal generation means may be for making a pitch change in the musical tone. The specified range may be predetermined based on a pre-set interval of musical notes.

For example, a chromatic semi, a chromatic quint, or an octave pitch interval of a musical scale, or the like may be predetermined and set for the specified range. Accordingly, the specified range in which the modulation (vibrato effect) may be applied is predetermined based on a pitch interval of a musical scale.

In some embodiments, the pitch parameter value input by the input means may correspond to a position of one or more controls of the operation terminal. The specified range may be predetermined based on the position of the one or more controls.

Because the pitch parameter value input by the input means may vary according to the position of the operation terminal (e.g., a pitch bend wheel) and the specified range may be set based on the position of the operation terminal, this may allow the user to know whether or not the modulation of the musical tone is being carried out via the operation terminal. Accordingly, the user may be able to control the modulation of the musical tone in accordance with the position of the operation terminal.

In further embodiments, the pitch parameter value input by the input means may correspond to a pitch parameter operation range of the one or more controls. The pitch parameter operation range may have one end and an other end. The specified range may be predetermined based on one of the one end of the pitch parameter operation range, the other end of the pitch parameter operation range, and a center point between the one end of the pitch parameter operation range and the other end of the pitch parameter operation range.

Because the pitch parameter value input by the input means may indicate pitch change information corresponding to a position of the operation terminal, the user may be able to recognize whether or not modulation of the musical control device is being carried out based on the position of the operation terminal from one end, through the center point, and to the other end.

For example, when a pitch bend wheel is in a normal state (a state in which the pitch bend wheel has not been operated), the position of the pitch bend wheel may be maintained in the center position, and the modulation effect may be added at the center pitch of the specified range. If the pitch bend wheel is operated and turned to the right and its position reaches one end of the range, the pitch may increase by one octave. On the other hand, if the pitch bend wheel is operated and turned to the left and its position reaches the other end of the range, the pitch may decrease by one octave. Accordingly, the vibrato effect may be applied when the position of the pitch bend wheel is placed in one of the center position, the end, or the other end of the range.

The device may be configured such that the vibrato effect is not applied when the position of the pitch bend wheel is placed in a position between the end of the range and the center point of the range and/or in a position between the other end of the range and the center point of the range. Similarly, the vibrato effect may not be applied in a case where the pitch bend wheel is positioned at one of the end, the center point, or the other end of range for an insufficient amount of time. This may be known as a "delayed vibrato." This allows the pitch bend wheel to move along the range without having the vibrato being applied until the pitch bend wheel stops at one of the end, the center point, or the other end of the range for a certain amount of time or more.

A musical tone control device in accordance with an embodiment of the present invention may include, but is not limited to, an input terminal, a processor, a first signal generator, a second signal generator, and an output terminal.

The input terminal may be configured to receive input data. The processor may be configured to determine whether the input data is within a specified range. The first signal generator may be configured to generate a first signal when the input data is within the specified range. The second signal generator may be configured to generate a second signal based on the input data and the first signal. The second signal may be for modulating a musical tone. The output terminal may be configured to output the second signal.

In various embodiments, the device may further include a signal suppression circuit. The signal suppression circuit may be configured to suppress the first signal when the input data is out of the specified range. In some embodiments, the signal suppression circuit may be configured to cancel the suppression of the first signal when the input data is within the specified range.

In various embodiments, the device may further include a timer. The timer may be configured to measure a length of time starting when the input data is within the specified range. The signal suppression circuit may be configured to cancel the suppression of the first signal when the length of time measured by the timer equals or exceeds a predetermined length of time.

In various embodiments, the input data and the second signal may be for making a pitch change in the musical tone. The specified range may be predetermined based on tonal intervals of musical notes.

In some embodiments, the first signal comprises a periodic signal. In some embodiments, the second signal comprises a modulation signal for the musical tone.

A tone control method in accordance with an embodiment of the present invention may include, but is not limited to, (i) receiving input data; (ii) determining whether the input data is within a specified range; (iii) generating a first signal when the input data is within the specified range; (iv) generating a second signal based on the input data and the first signal, the second signal for modulating a musical tone; and (v) outputting the second signal. In some embodiments, the first signal may comprise a periodic signal. In some embodiments, the second signal may comprise a modulation signal.

DETAILED DESCRIPTION OF PREFERRED EMBODIMENTS

Figure 1:
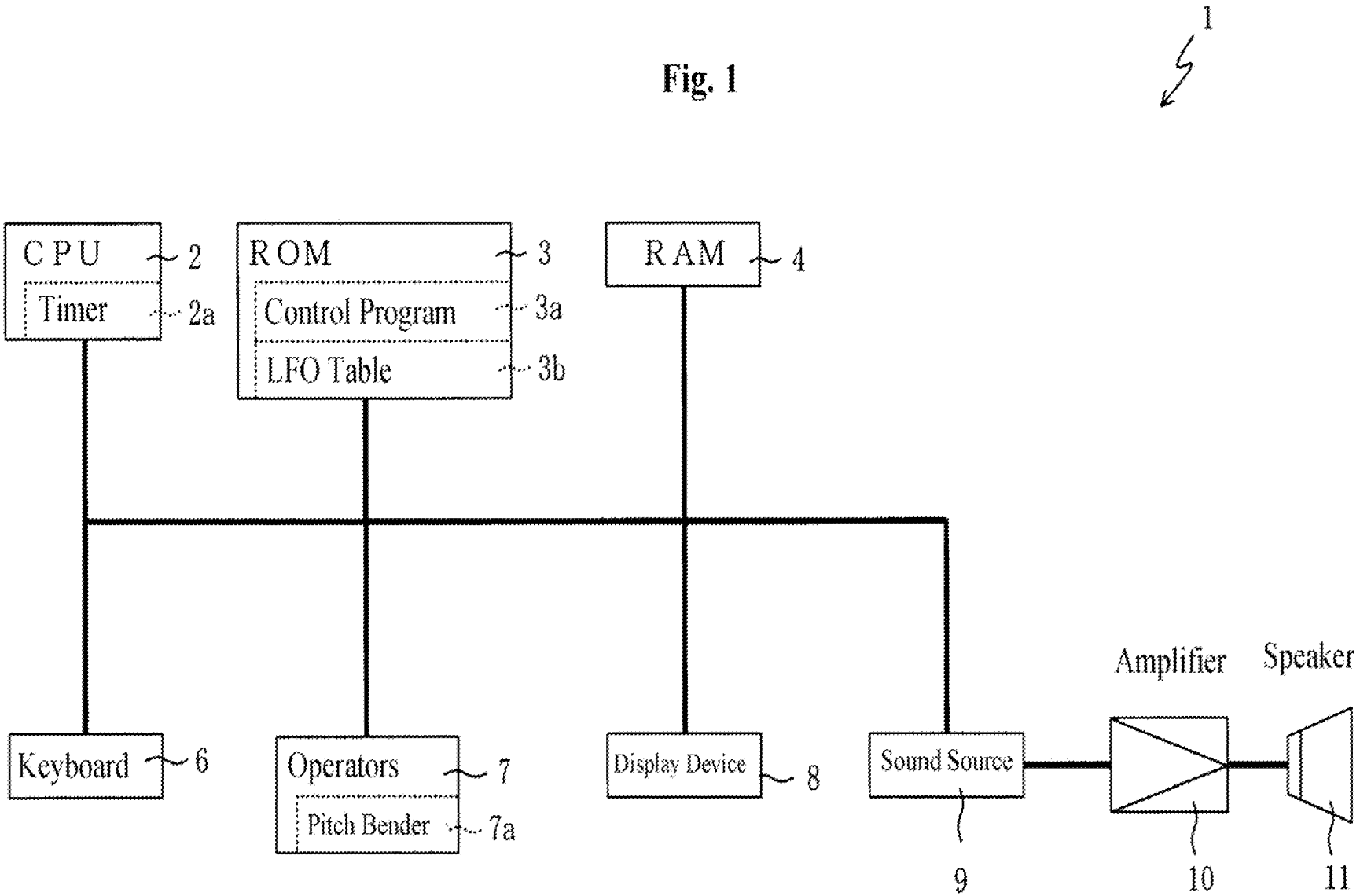
FIG. 1 is a block diagram showing an electrical configuration of an electronic musical instrument in accordance with an embodiment of the present invention.

FIG. 1 illustrates a block diagram of an electrical configuration of an electronic musical instrument 1 according to an embodiment of the present invention. The electronic musical instrument 1 may be configured to include a CPU 2 (central processing unit), a ROM 3 (read only memory), a RAM 4 (random access memory), a keyboard 6, a console panel 7, a display device 8, a sound source 9, an amplifier 10, and a speaker 11.

The ROM 3 may contain a control program 3*a* or the like, which may be executable by the CPU 2. The RAM 4 may supply a memory area for use by the CPU 2 when the control program 3*a* is executed. The keyboard 6 may have a plurality of white keys and black keys, or the like. The console panel 7 may allow a user to issue or otherwise input instructions to the electronic musical instrument 1. The display device 8 may be for displaying parameters set with the console panel 7. The sound source 9 may produce a musical tone signal in conformance with performance information transmitted by the CPU 2. The amplifier 10 may be for amplifying the musical tone signal produced by the sound source 9. The speaker 11 may be for emitting the musical tone signal amplified by the amplifier 10 as sound.

Figure 4:
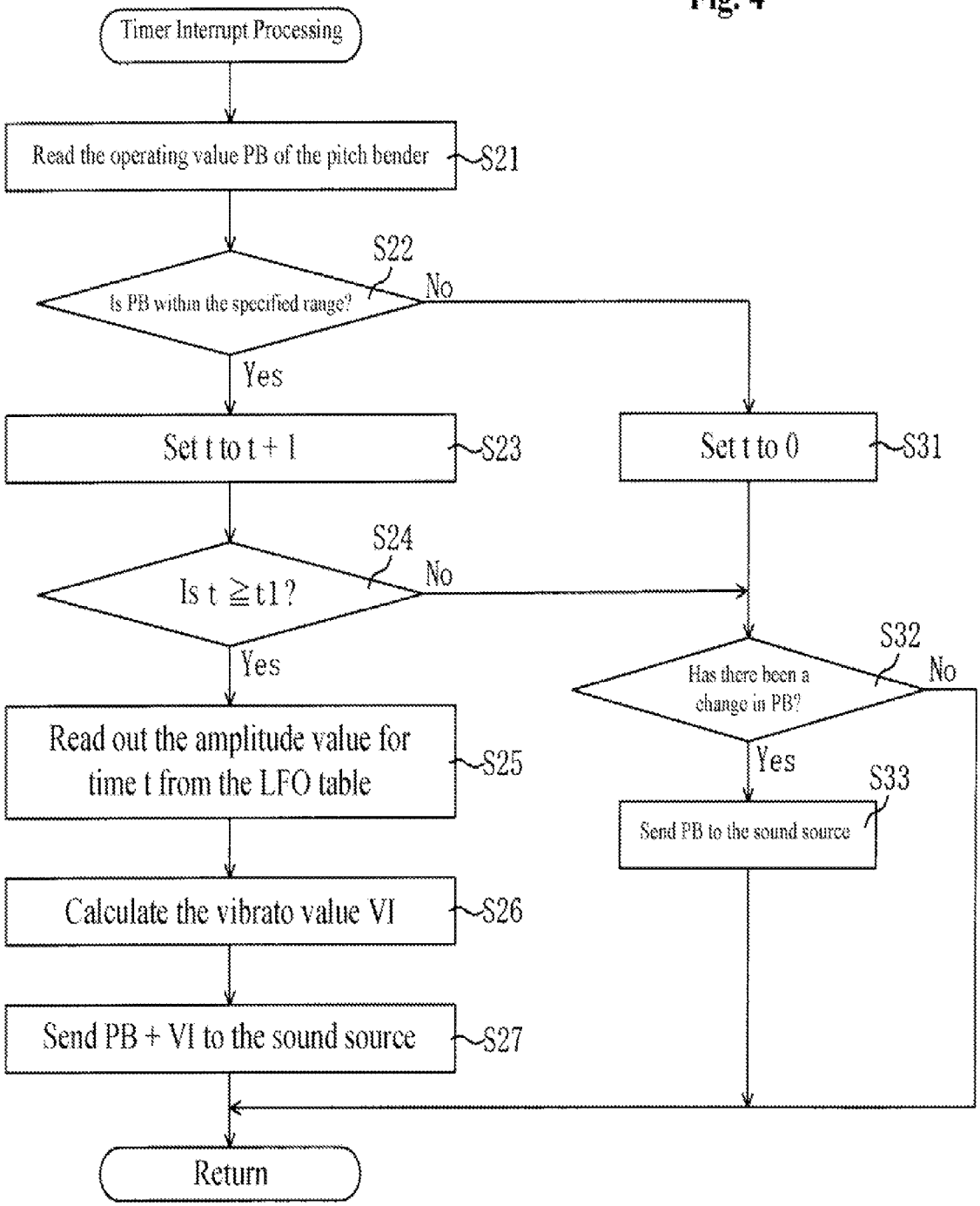
FIG. 4 is a flowchart for explaining an example of timer interrupt processing in accordance with an embodiment of the present invention.

The CPU 2 may be a central processing unit for executing various kinds of processes, programs, or the like in accordance with the control program 3*a* stored in the ROM 3. The CPU 2 may include a timer 2*a*. The timer 2*a* may be configured for inputting clock signals having specified frequencies. In addition, the timer 2*a* may be for measuring periods of time. The timer 2*a* and/or the CPU 2 may be configured such that each time the timer 2*a* times or otherwise measures a specified time period (e.g., 1 ms), an interrupt signal may be generated by the CPU 2. Accordingly, a timer interrupt process as shown in FIG. 4 may be executed by the CPU 2 in conformance with the interrupt signal.

With reference to FIG. 1, the ROM 3 may be memory that may not be rewritable. The ROM 3 may contain the control program 3*a*, which may be for carrying out the flowcharts shown in FIGS. 3 and 4. In addition to the control program 3*a*, various fixed data employable by the CPU 2 may be stored on the ROM 3. The ROM 3 may be accessed by the CPU 2 via a system bus (not shown). The ROM 3 may contain an LFO (low frequency oscillator) table 3*b*, which may be referred to when the control program 3*a* is executed. The LFO table 3*b* may be for storing various waveforms for periodically changing characteristics of the musical tone signal. For example, a cycle of a sine wave, a triangular wave, and the like may be stored within the LFO table 3*b* and may be selectable by the user.

The RAM 4 may be memory that may be randomly accessible. The RAM 4 may have a working area or the like for temporarily storing variables and the like at the time of execution of the control program 3*a* by the CPU 2. The values set by the console panel 7 may be stored in the RAM 4. A determination may be made as to whether or not a change has been made by the console panel 7 by way of a comparison with a previous value.

The keyboard 6 may be for carrying out performance operations by the user. In some embodiments, each of the white keys and the black keys may be maintained, for example, in a horizontal position by a bias member, such as a spring, or the like, while the keys are in a first state. By pressing on one of the keys, for example with a finger, a musical tone with a pitch assigned to that key may be generated. By releasing the key, the musical tone may stop being generated.

The console panel 7 may comprise various kinds of buttons, switches, controls, such as rotary controls, and the like. The console panel 7 may allow for selecting a tone, a volume, or the like, to be outputted by the sound source 9. In addition, the console panel 7 may be for selecting any one of the plurality of waveforms stored in the LFO table 3*b*.

The console panel 7 may include a pitch bend wheel 7*a*. In various embodiments, the pitch bend wheel 7*a* may be, but is not limited to, a spring-loaded pitch bend wheel, a slider, or the like. For example, when the pitch bend wheel 7*a* is moved up or down (or left or right) while one of the keys of the keyboard 6 is depressed, a tone of a note being produced may be raised or lowered in consonance with displacement of the pitch bend wheel 7*a*. In some embodiments, when the pitch bend wheel 7*a* is in a first state or normal state, the pitch bend wheel 7*a* may be held in a center position by a bias member, such as a spring, or the like. Accordingly, it may be possible to operate the pitch bend wheel 7*a* up or down (or left or right) using a finger, for example.

In some embodiments, the pitch bend wheel 7*a* may be for altering a pitch of a tone. In further embodiments, the pitch bend wheel 7*a* may be for applying a vibrato. In yet further embodiments, the pitch bend wheel 7*a* may be for altering a pitch of a tone and for applying a vibrato.

In various embodiments, the pitch bend wheel 7*a* may include a rotating shaft (not shown) and a variable resistor (not shown). The rotational displacement of the pitch bend wheel 7*a* may be detected as a voltage by the variable resistor (not shown), for example, and converted into a digital value by an A/D converter (not shown), linear converter, or the like, and then read by the CPU 2. In various embodiments, the pitch bend wheel 7*a* may control a pitch of a musical tone produced by the sound source 9 based on a value set with the pitch bend wheel 7*a*. However, in various other embodiments, volume and/or a cutoff frequency, or the like may likewise be controlled.

The sound source 9 may be for generating a musical tone based on a control signal transmitted by the CPU 2. For example, if the sound source 9 receives a Note On message, the generation of a musical tone having a pitch or a timbre indicated by the Note On message may begin. Likewise, if the sound source 9 receives a Note Off message, the generation of the musical tone may stop. Similarly, if the sound source 9 receives a modulation instruction message, the musical tone signal may be modulated in conformance with that message. In various embodiments, the modulation instruction message, for example, may instruct a changing of a pitch, a volume, and/or a frequency characteristic of the musical tone signal being generated.

Figure 2:
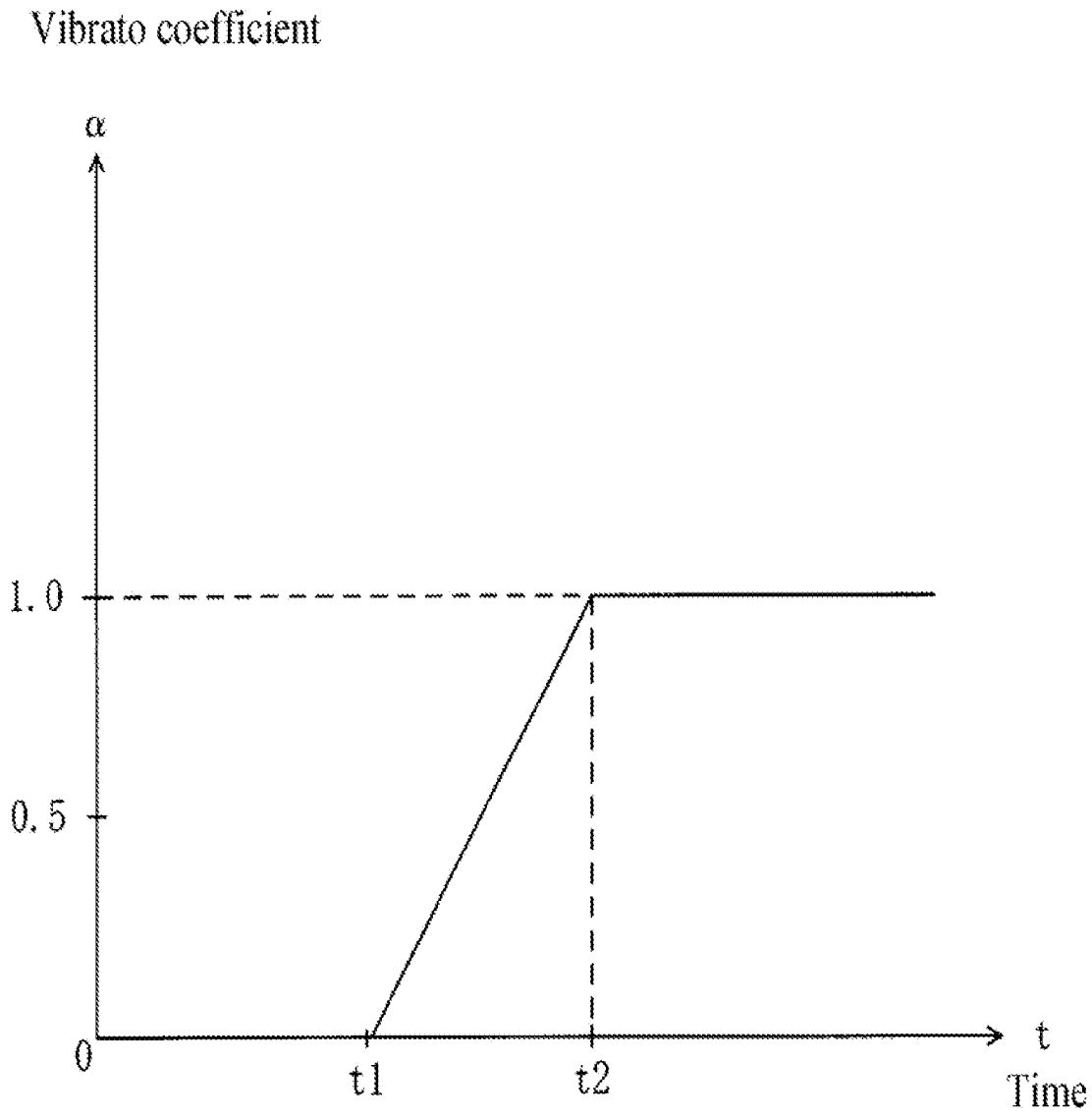
FIG. 2 is a graph showing a change in vibrato depth with respect to time in accordance with an embodiment of the present invention.

FIG. 2 illustrates an example of a graph demonstrating vibrato depth that may change with respect to time. According to FIG. 2, the horizontal axis may be a time t while the vertical axis may be a vibrato depth $\alpha$. The time t on the horizontal axis may be the time at which the timer 2*a* begins to measure a period of time. For example, the timer 2*a* may begin to measure a period of time when one of the keys of the keyboard is pressed, or when a current operating position of the pitch bend wheel 7*a* is within a specified range, which will be discussed later.

According to the embodiment shown in FIG. 2, the vibrato depth $\alpha$ may be 0 until time t1. The vibrato depth $\alpha$ may then gradually increase from time t1 until time t2 where the vibrato depth $\alpha$ may be 1.0. The vibrato depth $\alpha$ may be 1.0 from time t2 and beyond. The time from time t1 until time t2 is shown as a straight line in FIG. 2, but in various embodiments, a change in the vibrato depth $\alpha$ may be, for example, in the form of the letter S. For example, the vibrato depth $\alpha$ may rise from 0.0 to 1.0 at time t1 or time t2 rather than gradually increasing. As such, the vibrato depth $\alpha$ may change in accordance with a lapse of time in this manner.

In some embodiments, the vibrato depth α may be multiplied by a period signal provided from the LFO table 3*b*. Accordingly, during the period from time 0 until time t1, there may be no modulation using the period signal. Meanwhile, during the period from time t1 until time t2 (and/or beyond time t2), a modulation using the period signal may be applied.

In some embodiments, when a key of the keyboard 6 is pressed (e.g., at time 0), the vibrato is not applied until a short period of time after the key is pressed. This may be referred to as a delayed vibrato. For example, a key of the keyboard 6 is pressed at time 0. Accordingly, the vibrato may not be applied until time t1 is reached.

In various embodiments, the pitch bend wheel 7*a* may be manipulated to obtain a current operating position, which may correspond to an operating value, such as a pitch parameter value PB. For example, in a case where the current operating position of the pitch bend wheel 7*a* is centered, the pitch parameter value PB may be taken as 0. In a case where the current operating position is to one end of a range, the pitch parameter value PB may be taken as +100. In a case where the current operating position is to an other end of the range, the pitch parameter value PB may be taken as −100.

Accordingly, in a case where the pitch bend wheel 7*a* is in the first state or otherwise in an unoperated state, the current operating position of the pitch bend wheel 7*a* may be centered and the pitch parameter value PB may be taken as 0.

In some embodiments, the vibrato will not be applied unless the pitch parameter value PB is within a specified range, for example, between −100 to −98, ±2, and +98 to +100. In such an example, if the pitch bend wheel 7*a* is operated and exceeds the range of ±2 (and not within the other ranges), the vibrato depth α may be set to 0 and accordingly the vibrato may not be applied. Accordingly, at this time, the time t may be set to 0. Meanwhile, if the pitch bend wheel 7*a* is further operated and reaches a specified range (any one of the ranges of from −100 to −98, ±2, and from +98 to +100 described above), the timing of the time period t may start. In some embodiments, the vibrato may be applied when the pitch bend wheel 7*a* reaches one of the specified ranges. In other embodiments, the vibrato may be applied after the pitch bend wheel 7*a* remains within the one of the specified ranges for a certain amount of time (e.g., the difference between time t1 and time t0). Accordingly, the pitch and/or the vibrato can be altered depending on a location of the pitch bend wheel 7*a* in a specified range.

Figure 3:
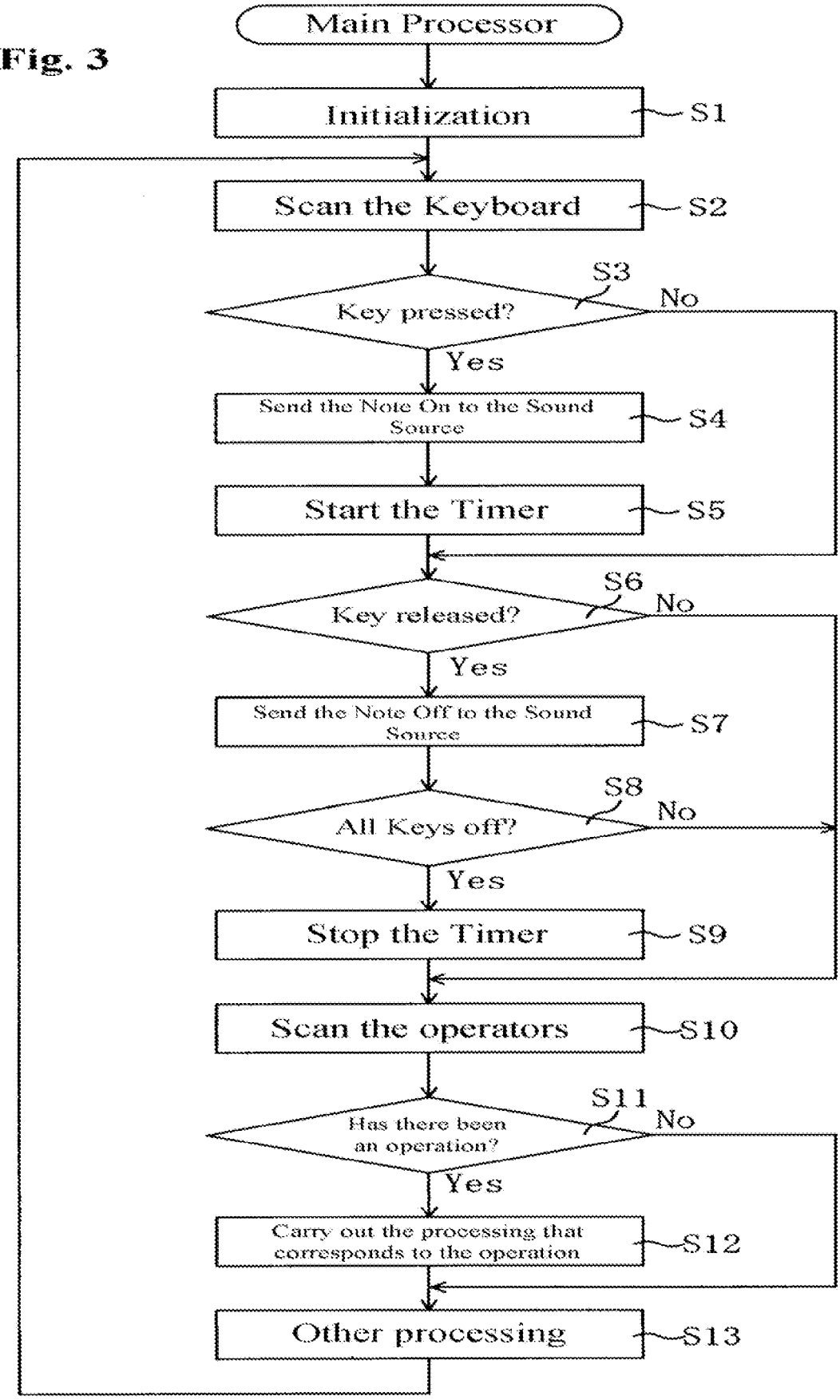
FIG. 3 is a flowchart for explaining an example of main processing in accordance with an embodiment of the present invention.

FIG. 3 illustrates a flow chart for an example of main processing executed by the CPU 2 according to an embodiment of the present invention. The main processing may be launched, for example, by turning on the power to the electronic musical instrument 1 and may be executed repeatedly until the power to the electronic musical instrument 1 is turned off. In addition, the program may be launched by resetting the electronic musical instrument 1.

In step S1, the initialization of the main processing may occur. During initialization, default values for various types of parameters may be set. For example, an internal status of the keyboard 6 may be set to an initial state to prevent unwanted tones from occurring when the power is switched on, a work area of the RAM 4 may be cleared, and data for a register, a message, a flag, a volume, a timbre, or the like, may be initialized.

Next in step S2, states of the keys of the keyboard 6 are scanned. In step S3, a determination may be made as to whether or not a key of the keyboard 6 has been pressed. During steps S2 and S3, data accompanying a depression of any of the keys of the keyboard 6 may be retrieved and stored in a predetermined area in the RAM 4.

If any of the keys of the keyboard 6 have been pressed (S3: yes), the Note On message for that key may be transmitted to the sound source 9 (step S4). The Note On message may include information such as, but limited to, note on status indicating the key has been pressed, a note number indicating the pitch assigned to the key, and a velocity at which the key has been pressed. Accordingly, the sound source 9 may receive the Note On message and start the generation of the musical tone having the pitch indicated by the note number and at the strength and timbre that correspond to the velocity at which the key has been pressed.

Next in step S5, the timer 2*a* starts. When the timer 2*a* determines that a predetermined period of time has passed (e.g., 1 ms), an interrupt signal may be transmitted to the CPU 2 and the timer interrupt processing may be performed.

If, during step S3, none of the keys of the keyboard have been pressed (S3: no), or if step S5 has been carried out, a determination may be made as to whether or not any of the keys of the keyboard 6 have been released (step S6). Accordingly, data accompanying the release of the keys of the keyboard 6 may be retrieved and stored in a predetermined area in the RAM 4.

If any of the keys of the keyboard 6 have been released (S6: yes), the Note Off message for that key may be transmitted to the sound source 9 (step S7). The Note Off message may include information such as, but not limited to, note off status indicating the key has been released, a note number indicating the pitch assigned to the key, and a velocity at which the key has been released. Accordingly, the sound source 9 may receive the Note Off message and may attenuate the generation of the musical tone having a pitch indicated by the note number and the velocity at which the key has been released.

Next in step S8, a determination may be made as to whether or not none of the keys of the keyboard 6 has been pressed. If none of the keys of the keyboard 6 have been pressed (S8: yes), the timer 2*a* may stop and accordingly the timer interrupt processing is not performed (step S9).

If, during step S6, none of the keys of the keyboard 6 have been released (S6: no), or if, during step S8, none of the keys of the keyboard 6 have been pressed, (S8: no), or if step S9 has been carried out, the console panel 7 may be scanned next (step S10). Accordingly, in step S11, a determination may be made as to whether or not any controls of the console panel 7 have been operated. For example, during steps S10 and S11, a switch, or the like, from the console panel 7 can be operated. For instance, timbre selection, rhythm selection, and volume control may be respectively performed by a manipulation of a timbre select switch, a rhythm select switch, and a volume switch.

If the console panel 7 has been operated (S11: yes), processing corresponding to that operation may be carried out (step S12). For example, if the pitch bend wheel 7*a* has been operated, an pitch parameter value PB, which indicates a current operating position of the pitch bend wheel 7*a*, may be stored in the RAM 4. If, for example, the timbre has been manipulated, information indicating the newly selected timbre may be transmitted to the sound source 9.

If, during step S11, the console panel 7 has not been operated (S11: no), or if step S12 has been carried out, then any other processing not yet performed during steps S10 and S11, may be carried out in step S13. Once the other processing has been carried out, the main processing program may return to step S2 and the process may be repeated from there.

FIG. 4 illustrates a flowchart explaining an example of timer interrupt processing when the pitch bend wheel 7*a* is operated according to an embodiment of the present invention. When the timer 2*a* determines that a predetermined period of time has elapsed, an interrupt signal may be transmitted to the CPU 2 and the timer interrupt processing may be performed.

First in step S21, the pitch parameter value PB set by the pitch bend wheel 7*a* may be loaded from the RAM 4. Then in step S22, a determination may be made as to whether or not the pitch parameter value PB is within a specified range. If the pitch parameter value PB is within the specified range (S22: yes), the time t may increase by 1 (step S23). Then in step S24, a determination may be made as to whether or not the time t has reached time t1. If the time t has reached time t1 (S24: yes), an amplitude value provided in the LFO table 3*b* corresponding to the time t may be read out from the LFO table 3*b* (step S25).

In step S26, a vibrato value VI may be calculated by multiplying the amplitude value read from the LFO table 3*b* by the vibrato depth $\alpha$ corresponding to the time t, for example as illustrated in FIG. 2. In various embodiments, the vibrato depth $\alpha$ may be further multiplied by a user-defined coefficient.

Next in step S27, the pitch parameter value PB set by the pitch bend wheel 7*a* and the vibrato value VI may be added together and transmitted to the sound source 9. On the other hand, if, during step S22, the pitch parameter value PB is not within the specified range (S22: no), the time t may be set to 0 (step S31) and the vibrato may not be applied. If step S31 has been carried out, or if, during step S24, the time t1 has not been reached (S24: no), a determination may be made as to whether or not the pitch parameter value PB has changed (step S32). As will be discussed later (in step S33), the pitch parameter value PB transmitted to the sound source 9 may be stored in the RAM 4 and the determination as to whether or not there has been a change may be made by a comparison between that pitch parameter value PB and a previously obtained pitch parameter value PB.

If the pitch parameter value PB has been changed (S32: yes), the changed pitch parameter value PB may be transmitted to the sound source 9 (step S33). In addition, the changed pitch parameter value PB may be stored in the RAM 4. If step S33 has been carried out, or if the pitch parameter value PB has not changed (S32: no), the timer interrupt processing may end.

As previously discussed, in various embodiments, in a case where a periodic vibrato is set and the pitch bend wheel 7*a* is operated and the current operating position of the pitch bend wheel 7*a* is within the specified range, a vibrato may be applied. Otherwise, a vibrato is not applied.

Accordingly, in some embodiments until the pitch bend wheel 7*a* is manipulated or otherwise operated to reach a specified position or range the vibrato may be suppressed. Once the pitch bend wheel 7*a* is manipulated or otherwise operated to reach a specified position or range the vibrato may be applied. In various embodiments, once the pitch bend wheel 7*a* is manipulated or otherwise operated to reach a specified position or range the vibrato depth may gradually increase after a lapse of a specified period of time.

Incidentally, for the input means cited in the claims, processing of step S12 of the flowchart shown in FIG. 3 may apply. For the period signal means, processing of step S25 of the flowchart shown in FIG. 4 may apply. For the modulation signal generation means and the output means, processing of steps S27 and S33 of the flowchart shown in FIG. 4 may apply. For the determination means, processing of step S22 of the flowchart shown in FIG. 4 may apply. In addition, for the timing means cited in Claim 3, processing of step S23 of the flowchart shown in FIG. 4 may apply.

In various embodiments, the keyboard 6, the control panel 7, and the sound source 9 may be connected to the CPU 2 via the system bus (not shown). In some embodiments, the keyboard 6, the control panel 7, and/or the sound source 9 may be connected through an interface, such as a MIDI, and the like. In such embodiments, the pitch parameter value PB generated by operating the pitch bend wheel 7*a* may be transmitted and received with a control stipulated in the MIDI specifications.

In various embodiments, an pitch parameter value set with the console panel 7 may indicate the current position of a particular control of the console panel 7. In some embodiments, the pitch parameter value may instruct a pitch corresponding to the position of the particular control. For example, if the pitch bend wheel 7*a* is manipulated to the right, this may correspond to a +1 octave, while if the pitch bend wheel 7*a* is manipulated to the left, this may correspond to a −1 octave. The pitches may change discretely by half tones in the interval between the −1 octave and the +1 octave.

In various embodiments, if the pitch parameter value is not within a specified range, then there may be no modulation using the period signal. In other embodiments, if the pitch parameter value is not within a specified range, then there may be a slight modulation using the period signal.

In various embodiments, the period of time between pressing down a key on the keyboard 6 and the application of the vibrato may be equivalent to the period of time (e.g., time t1) between the current operating position of the pitch bend wheel 7*a* reaching the specified range and the application of the vibrato. In other embodiments, the period of time between pressing down a key on the keyboard 6 and the application of the vibrato may be different from the period of time between the current operating position of the pitch bend wheel 7*a* reaching the specified range and the application of the vibrato.

In various embodiments, if the operating position of the pitch bend wheel 7*a* changes from within the specified range to outside the specified range, the vibrato coefficient a may change discretely from 1 to 0. In other embodiments, if the operating position of the pitch bend wheel 7*a* changes from within the specified range to outside the specified range, the vibrato coefficient a may change gradually from 1 to 0.

The embodiments disclosed herein are to be considered in all respects as illustrative, and not restrictive of the invention. The present invention is in no way limited to the embodiments described above. Various modifications and changes may be made to the embodiments without departing from the spirit and scope of the invention. The scope of the invention is indicated by the attached claims, rather than the embodiments. Various modifications and changes that come within the meaning and range of equivalency of the claims are intended to be within the scope of the invention.

What is claimed is:

1. A musical tone control device comprising:

an input means for inputting a pitch parameter value corresponding to an operation of an operation terminal;

a period signal generation means for generating a periodic signal;

a modulation signal generation means for generating a modulation signal based on the pitch parameter value input by the input means and the periodic signal generated by the period signal generation means, the modulation signal for modulating a musical tone;

an output means for outputting the modulation signal generated by the modulation signal generation means;

a determination means for determining whether the pitch parameter value input by the input means is within a specified parameter range; and a control means for suppressing the periodic signal when the determination means determines that the pitch parameter value input by the input means is out of the specified parameter range, the control means for cancelling the suppressing of the periodic signal when the determination means determines that the pitch parameter value input by the input means is within the specified parameter range.

2. The musical tone control device of claim 1, the device further comprising:

a timing means for measuring a length of time from when the pitch parameter value input by the input means changes from a value that was out of the specified parameter range to a value that is within the specified parameter range;

wherein the control means cancels the suppressing of the periodic signal when the length of time measured by the timing means equals or exceeds a predetermined length of time.

3. The musical tone control device of claim 2, wherein the pitch parameter value input by the input means and the modulation signal generated by the modulation signal generation means are for making a pitch change in the musical tone; and wherein the specified range is predetermined based on a pre-set interval of musical notes.

4. The musical tone control device of claim 2, wherein the pitch parameter value input by the input means corresponds to a position of one or more controls of the operation terminal; and wherein the specified range is predetermined based on the position of the one or more controls.

5. The musical tone control device cited in claim 4, wherein the pitch parameter value input by the input means corresponds to a pitch parameter operation range of the one or more controls, the pitch parameter operation range having one end and an other end; and wherein the specified range is predetermined based on one of the one end of the pitch parameter operation range, the other end of the pitch parameter operation range, and a center point between the one end of the pitch parameter operation range and the other end of the pitch parameter operation range.

6. The musical tone control device of claim 1, wherein the pitch parameter value input by the input means and the modulation signal generated by the modulation signal generation means are for making a pitch change in the musical tone; and wherein the specified range is predetermined based on a pre-set interval of musical notes.

7. The musical tone control device of claim 1, wherein the pitch parameter value input by the input means corresponds to a position of one or more controls of the operation terminal; and wherein the specified range is predetermined based on the position of the one or more controls.

8. The musical tone control device cited in claim 1, wherein the pitch parameter value input by the input means corresponds to a pitch parameter operation range of the one or more controls, the pitch parameter operation range having one end and an other end; and wherein the specified range is predetermined based on one of the one end of the pitch parameter operation range, the other end of the pitch parameter operation range, and a center point between the one end of the pitch parameter operation range and the other end of the pitch parameter operation range.

9. A tone control device, the device comprising:

an input terminal configured to receive a pitch parameter value corresponding to an operation of an operation terminal;

a processor configured to determine whether the pitch parameter value is within a specified range;

a first signal generator configured to generate a first signal;

a second signal generator configured to generate a second signal based on the pitch parameter value modulated by the first signal in response to the determination of the processor, the second signal for modulating a musical tone; and an output terminal configured to output the second signal.

10. The tone control device of claim 9, the device further comprising:

a signal suppression circuit configured to suppress the first signal when the pitch parameter value is out of the specified range of the pitch parameter value.

11. The tone control device of claim 10, wherein the signal suppression circuit is configured to cancel the suppression of the first signal when the pitch parameter value is within the specified range of the pitch parameter value.

12. The tone control device of claim 10, the device further comprising:

a timer configured to measure a length of time starting when the pitch parameter value is within the specified range of the pitch parameter value;

the signal suppression circuit configured to cancel the suppression of the first signal when the length of time measured by the timer equals or exceeds a predetermined length of time.

13. The tone control device of claim 9, wherein the pitch parameter value and the second signal are for making a pitch change in the musical tone; and wherein the specified range of the pitch parameter value is predetermined based on tonal intervals of musical notes.

14. The tone control device of claim 9, wherein the first signal comprises a periodic signal.

15. The tone control device of claim 9, wherein the second signal comprises a modulation signal for the musical tone.

16. A tone control method, the method comprising:

receiving a pitch parameter value corresponding to an operation of an operation terminal;

determining whether the pitch parameter value is within a specified range of the pitch parameter value;

generating a first signal;

modulating the pitch parameter value with the first signal;

generating a second signal based on the pitch parameter value modulated by the first signal in response to the determination, the second signal for modulating a musical tone; and outputting the second signal.

17. The tone control method of claim 16, wherein the first signal comprises a periodic signal.

18. The tone control method of claim 16, wherein the second signal comprises a modulation signal.

19. A tone control device, the device comprising:

an input terminal configured to receive input data;

a processor configured to determine whether the input data is within a specified range;

a first signal generator configured to generate a first signal;

a second signal generator configured to generate a second signal based on the input data and the first signal, the second signal for modulating a musical tone;

an output terminal configured to output the second signal; and a signal suppression circuit configured to suppress the first signal when the input data is out of the specified range of the input data, the signal suppression circuit further configured to cancel the suppression of the first signal when the input data is within the specified range.

20. The tone control device of claim 19, wherein the input data comprises a pitch parameter value corresponding to an operation of an operation terminal.

* * * * *